United States Patent [19]

Saito et al.

[11] Patent Number: 4,747,492

[45] Date of Patent: May 31, 1988

[54] NOTE SORTING AND COUNTING APPARATUS

[75] Inventors: Tetsuo Saito; Kazunori Umezaki; Toshiya Takahashi; Osami Katsumata; Mitsuo Ikemi; Toshio Numata, all of Himeji, Japan

[73] Assignee: Glory Kogyo Kabushiki Kaisha, Himeji, Japan

[21] Appl. No.: 832,943

[22] Filed: Feb. 26, 1986

[30] Foreign Application Priority Data

Feb. 28, 1985 [JP] Japan ..... 60-37469
Feb. 28, 1985 [JP] Japan ..... 60-37470
Feb. 28, 1985 [JP] Japan ..... 60-37471

[51] Int. Cl.[4] ..... B07C 5/34

[52] U.S. Cl. ..... 209/534; 209/551; 271/189; 271/218

[58] Field of Search ..... 209/534, 551, 548, 900; 235/379; 271/192, 189, 218

[56] References Cited

U.S. PATENT DOCUMENTS

| | | | |
|---|---|---|---|
| 4,326,636 | 4/1982 | Kawakami | 209/534 |
| 4,398,088 | 8/1983 | Hirose et al. | 209/534 |
| 4,458,816 | 7/1984 | Horino et al. | 209/548 |
| 4,465,192 | 8/1984 | Ohba et al. | 209/534 |
| 4,465,193 | 8/1984 | Kokubo et al. | 209/534 |
| 4,494,655 | 1/1985 | Horii et al. | 209/900 |
| 4,570,801 | 2/1986 | Brannen | 209/551 |

FOREIGN PATENT DOCUMENTS

| | | | |
|---|---|---|---|
| 0119297 | 9/1979 | Japan | 209/534 |
| 2127792 | 4/1984 | United Kingdom | 209/534 |

*Primary Examiner*—Johnny D. Cherry
*Assistant Examiner*—Donald T. Hajec
*Attorney, Agent, or Firm*—Beveridge, DeGrandi & Weilacher

[57] ABSTRACT

A note sorting and counting apparatus includes a draw-out unit for drawing out in succession notes accumulated in a stack, a discrimination unit for discriminating at least denomination of notes drawn out by the draw-out unit, a sorting unit for sorting notes according to the denomination of notes on the basis of the denomination discriminated by the discrimination unit, a plurality of temporary reserving units for temporarily reserving the notes sorted by the sorting unit according to the denomination of note, a judgement or determining unit for judging or determining whether the temporary reserving units are filled with notes, a corresponding plurality of containers for receiving notes accommodated in the temporary reserving unit according to the denomination of the stacked notes, and a control unit for causing the transfer of notes reserved in the temporary reserving units to their respective containers. The note sorting and counting apparatus is configured so that notes of the denomination filled in the temporary reserving unit will be transferred immediately to its respective container, with the result that there is no need for an operator to give each a transfer instruction. The apparatus makes it possible to accommodate notes of all denominations into the containers when a cycle of processing is completed or in the similar case.

7 Claims, 15 Drawing Sheets

FIG. 6

| | CONTAINER / MODE | 1 st | 2 nd | 3 rd | 4 th | 5 th | 6 th | 7 th |
|---|---|---|---|---|---|---|---|---|
| A | SORTING·BATCH | $ 100 (OBVERSE) | $ 50 (OBVERSE) | $ 1 (OBVERSE) | $ 5 (OBVERSE) | $ 10 (OBVERSE) | $ 20 (OBVERSE) | R J REVERSE $ 2 |
| B | NORMAL/DAMAGED·BATCH | | | NORMAL NOTE (OBVERSE) | NORMAL NOTE (OBVERSE) | DAMAGED NOTE (OBVERSE) | DAMAGED NOTE (OBVERSE) | R J REVERSE $ 2 |
| C | DESIGNATED DENOMINATION·NORMAL/DAMAGED·BATCH | | DIFFERENT DENOMI-NATION | NORMAL NOTE (OBVERSE) | NORMAL NOTE (OBVERSE) | DAMAGED NOTE (OBVERSE) | DAMAGED NOTE (OBVERSE) | R J REVERSE $ 2 |

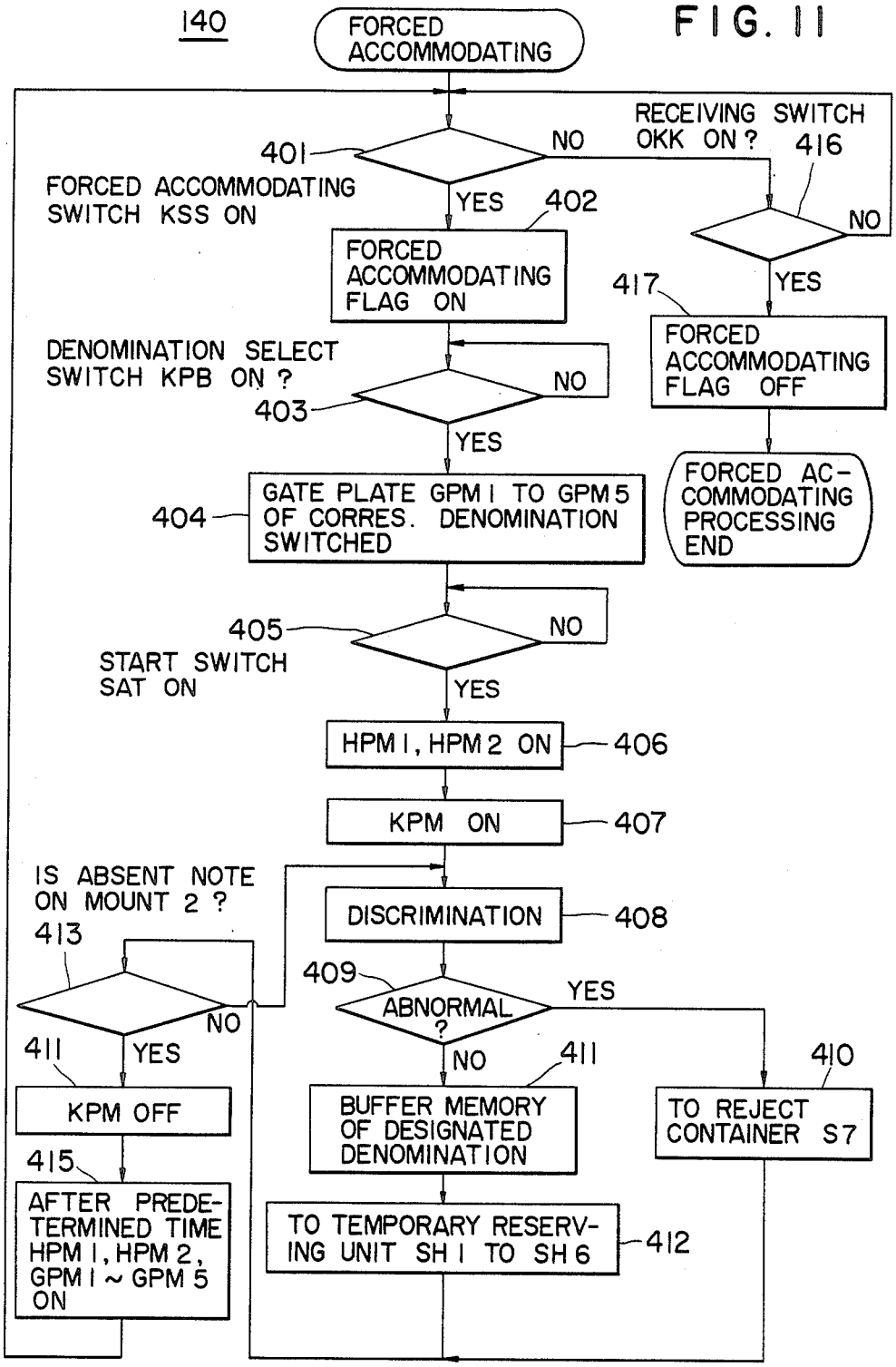
140
FORCED ACCOMMODATING
FIG. 11
401
FORCED ACCOMMODATING SWITCH KSS ON
NO
YES
402
FORCED ACCOMMODATING FLAG ON
RECEIVING SWITCH OKK ON ?
416
NO
YES
417
FORCED ACCOMMODATING FLAG OFF
FORCED ACCOMMODATING PROCESSING END
DENOMINATION SELECT SWITCH KPB ON ?
403
NO
YES
404
GATE PLATE GPM 1 TO GPM 5 OF CORRES. DENOMINATION SWITCHED
405
START SWITCH SAT ON
NO
YES
HPM 1, HPM 2 ON
406
KPM ON
407
IS ABSENT NOTE ON MOUNT 2 ?
413
NO
YES
411
KPM OFF
415
AFTER PREDETERMINED TIME HPM 1, HPM 2, GPM 1 ~ GPM 5 ON
DISCRIMINATION
408
409
ABNORMAL ?
YES
NO
411
BUFFER MEMORY OF DESIGNATED DENOMINATION
TO TEMPORARY RESERVING UNIT SH 1 TO SH 6
412
410
TO REJECT CONTAINER S7

NOTE SORTING AND COUNTING APPARATUS

BACKGROUND OF THE INVENTION

The present invention relates to a note sorting and counting apparatus for drawing out one by one notes (or bills) accumulated in a stack to accommodate or transfer them into different containers according to the denomination of note, respectively.

With conventional note sorting and counting apparatus, notes accumulated are drawn out one by one to sort them according to the denomination of note to temporarily reserve the notes which have been sorted according to the denomination of note. After an operation is conducted to sort and reserve notes in connection with notes to be processed once, upon completion of such sorting and reserving processes, notes are accommodated or transfer into a container. When a temporary reserving unit is filled with notes, an operator takes out them once by hand. Accordingly, this is inconvenient in that the operator always must attend to the machine.

Further, since notes within the temporary reserving unit are automatically accommodated into the container per each processing, when the amount of notes subject to sorting processing at a time is relatively small, accommodating operation must be frequently carried out, resulting in prolonged work hours.

Assume now that notes are drawn out every a predetermined number of notes with the conventional sorting and counting apparatus. Even when drawing out of notes is immediately stopped at the time when a predetermined number of notes are counted, some notes have been already taken out by a take-out unit. These notes are conveyed to a reject unit separately provided. In this instance, they are mixed with abnormal notes. In addition, since some notes are transferred to the reject unit every time drawing out of a predetermined number of notes occurs. As a result, it is possible that an operator selects only normal notes or that the operator is burdened in that the reject unit is frequently filled with notes, so that the operator must often draw out them.

When notes drawn out are discriminated in the discrimination unit, notes showing the reverse or back side, a chain of notes, notes abnormal in thickness (two thicknesses of notes) or notes obliquely shifted are rejected. It is reasonable to reject forged or false notes, etc. However, because the above-mentioned notes are not normal solely in their conveying condition in spite of the fact that they are normal, they are caused to be rejected. As a result, these notes cannot be sorted and counted.

SUMMARY OF THE INVENTION

A first object of the present invention is to provide a note sorting and counting apparatus wherein when a temporary reserving unit is filled with notes, the apparatus can automatically contain them into a container.

A second object of the present invention is to provide a note sorting and counting apparatus which can suitably effect a transfer of notes form a temporary reserving unit to a container.

A third object of the present invention is to provide a note sorting and counting apparatus wherein after a predetermined number of notes are drawn out, the apparatus functions to eliminate the possibility that normal notes are rejected.

A fourth object of the present invention is to provide a note sorting and counting apparatus making it possible to sort and count normal notes conveyed in an abnormal condition.

The above mentioned objects are achieved by the provision of a note sorting and counting apparatus comprising a draw-out unit for drawing out one by one notes accumulated in a stack, a discrimination unit for discriminating at least the denomination of notes drawn out by the draw-out unit, a sorting unit for sorting notes according to the denomination of note on the basis of the denomination discriminated by the discrimination unit, temporary reserving units for temporarily reserving the notes sorted by the sorting unit according to the denomination of note, a judgement or determing unit for judging or determing whether these temporary reserving units are filled with notes temporarily reserved, a container for accommodating or receiving a stack of notes accommodated in said temporary reserving unit according to the denomination of the notes, and a control unit for transferring the notes reserved in said temporary reserving units to their respective containers.

Further, the above-mentioned object is achieved by the provision of a note sorting and counting apparatus comprising a draw-out unit for drawing out one by one notes accumulated in a stack, a discrimination unit for discriminating at least the denomination of notes drawn out by the draw-out unit, a sorting unit for sorting notes according to the denomination of note on the basis of the denomination discriminated by the discrimination unit, a container for accommodating or receiving, according to the discrimination of note, the notes sorted by the sorting unit, a stop control unit for stopping the operation of the draw-out unit when the number of notes discriminated in said discrimination unit is equal to a predetermined setting value, and a note stand-by unit for holding notes which have been already drawn out by said draw-out unit when the operation of the draw-out unit is stopped by said stop control unit.

Furthermore, the above-mentioned object is achieved by the provision of a note sorting and counting apparatus comprising a draw-out unit for drawing out one by one notes accumulated in a stack, a discrimination unit for discriminating between normal notes and abnormal ones drawn out by the draw-out unit and to discriminate or determine denomination of the normal notes, a sorting unit for sorting the notes into normal notes and abnormal notes on the basis of the determination by the discrimination unit and to sort the normal notes from the abnormal ones, an abnormal note container for accommodating the abnormal notes sorted by the sorting unit, a container for accommodating or receiving, according to the denomination of note, the normal notes sorted by the sorting unit according to the denomination of note, a forced accommodating or transfer instructing unit for instructing a forced accommodating or transfer, a designation unit for designating the denomination of notes to be forcedly accommodated, and a forced accommodating or transferring control unit for forcedly accommodating or transferring the notes drawn out from said draw-out unit into the container corresponding to the denomination of notes as designated by said designation unit.

BRIEF DESCRIPTION OF THE DRAWINGS

FIG. 6 is a Table showing allocation of a container in various modes;

FIG. 11 is a flowchart showing the operation of a forced accommodating processing.

DETAILED DESCRIPTION OF THE INVENTION

Figure 1A:
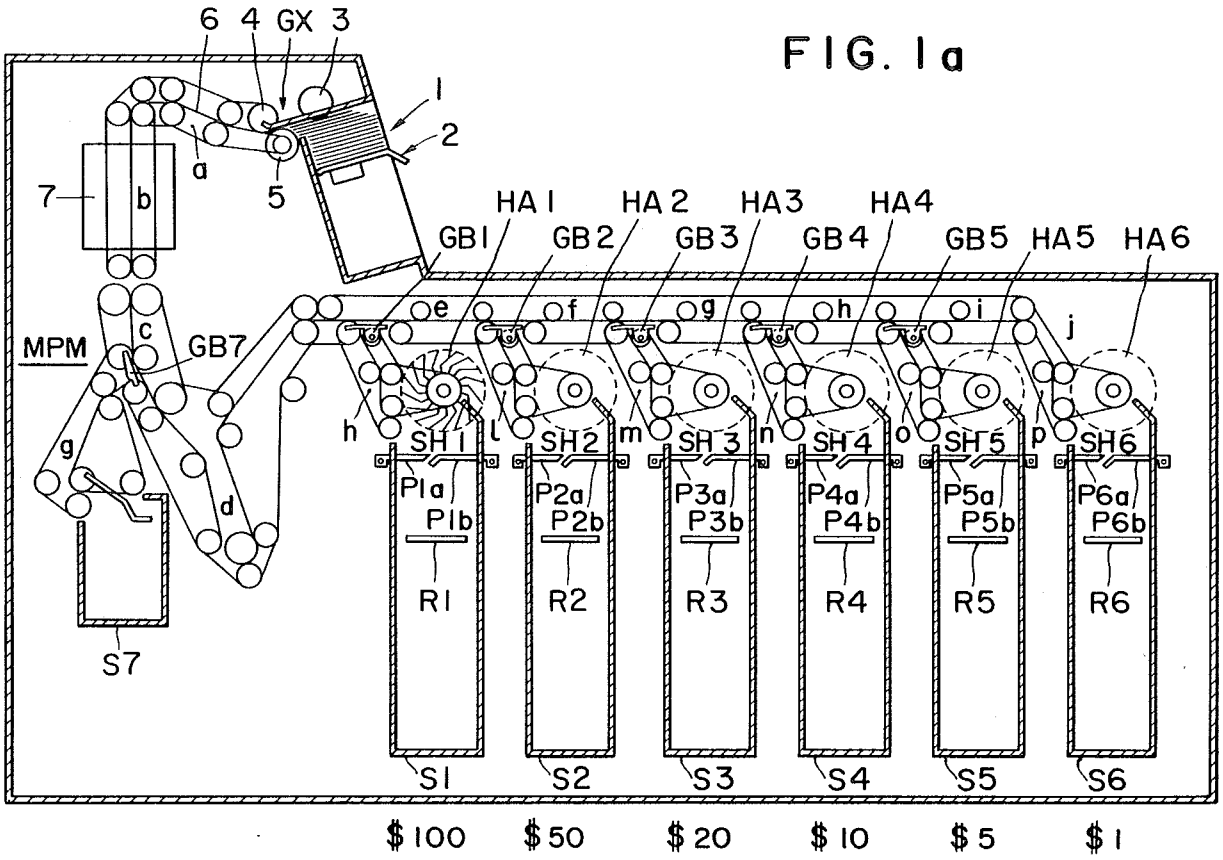
FIGS. 1*a* to 1*c* are diagrammatical views illustrating an embodiment of a note sorting and counting apparatus according to the present invention, respectively.

FIG. 1 shows a schematic view illustrating the entirety of a note sorting and counting apparatus body of an embodiment according to the present invention.

On the upper and front surface of the sorting and counting apparatus body, there is provided a pocket 1 for inserting notes therethrough. Behind the pocket 1, there is provided a mount 2 on which notes to be counted are placed. An operator places a bundle of notes on the mount 2 by hand. A draw-out roller 3 is projected downwardly slightly from the upper surface of the pocket 1 above the mount 2 to draw out notes accumulated one by one from the upward direction.

The notes drawn out by the draw-out roller 3 each pass gate rollers 4 and 5 provided at a gate GX and are conveyed one by one by a conveying belt 6.

Each of the notes conveyed one by one (i.e. successively) is discriminated by a discrimination unit 7 in connection with the truth or falsehood, denomination, obverse or reverse, normal or damaged condition, thickness, chain, condition of oblique displacement with respect to the normal position, and broken condition, etc. For the technique itself for this discrimination, any one of known techniques may be employed. Since such a technique is not the feature of the present invention, its detailed description will be omitted.

The conveying belt 6 is driven by drive motors HPM1 and HPM2 (FIG. 1*c*) as a conveying unit MPM, which is made up of a conveyer system labeled a to q. In addition, impellers or runners HA1 to HA6 are rotationally driven in synchronism with the conveying belt 6.

The notes are classified according to the discrimination result at the discrimination unit 7 and then are accommodated or transferred into containers S1 to S7.

The kind of the notes accommodated or transferred into the respective containers is different according to classification modes as shown in the Table of FIG. 6.

At the conveyer system labeled e to i, notes are sorted by gate plates GB1 to GB5 according to the discrimination result. The notes thus sorted are fed to the respective containers S1 to S6.

The notes which have been sent by the conveyer system labeled k to p are stacked on a lower position i.e. on supporting plates P1*a* to P6*a* and P1*b* and P6*b* of the temporary reserving unit SH1 to SH6 by the impellers HA1 to HA6 rotating counterclockwise in the figure (in a manner that each note is put by impeller plates). These supporting plates P1*a* to P6*a* and P1*b* to P6*b* are usually biased upwardly by springs shown in FIG. 2 so that they are in contact with blades of the impellers HA1 to HA6, respectively. The notes which have been conveyed to the blades are in contact with the guide plates, so that they are stacked on a lower position of the impellers i.e. on the supporting plates P1*a* to P6*a* and P1*b* to P6*b*. As a result, the supporting plates are gradually lowered against the spring force as shown in FIG. 2.

Figure 2B:
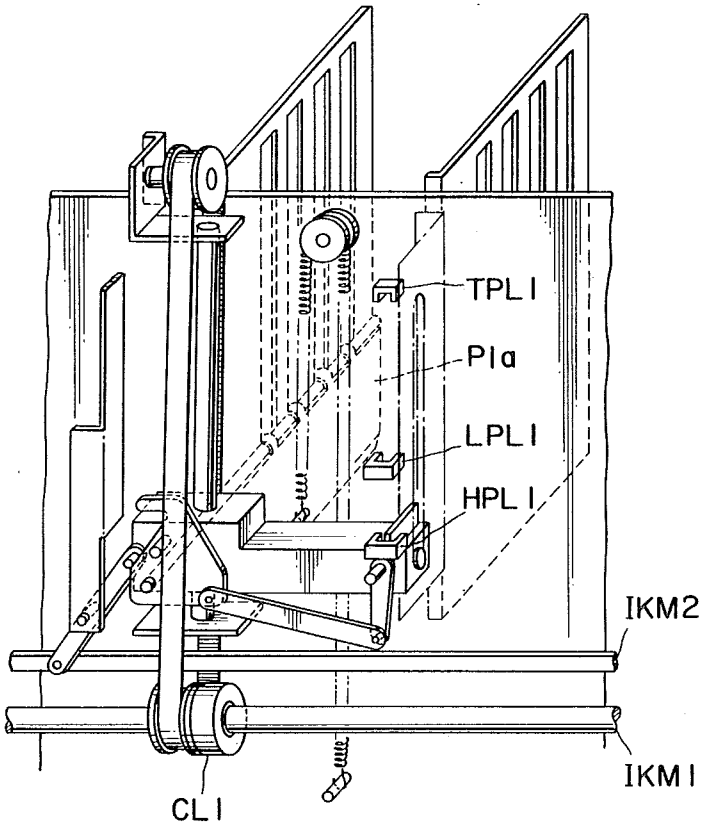
FIGS. 2*a* and 2*b* are perspective views showing a temporary reserving unit.
Figure 2A:
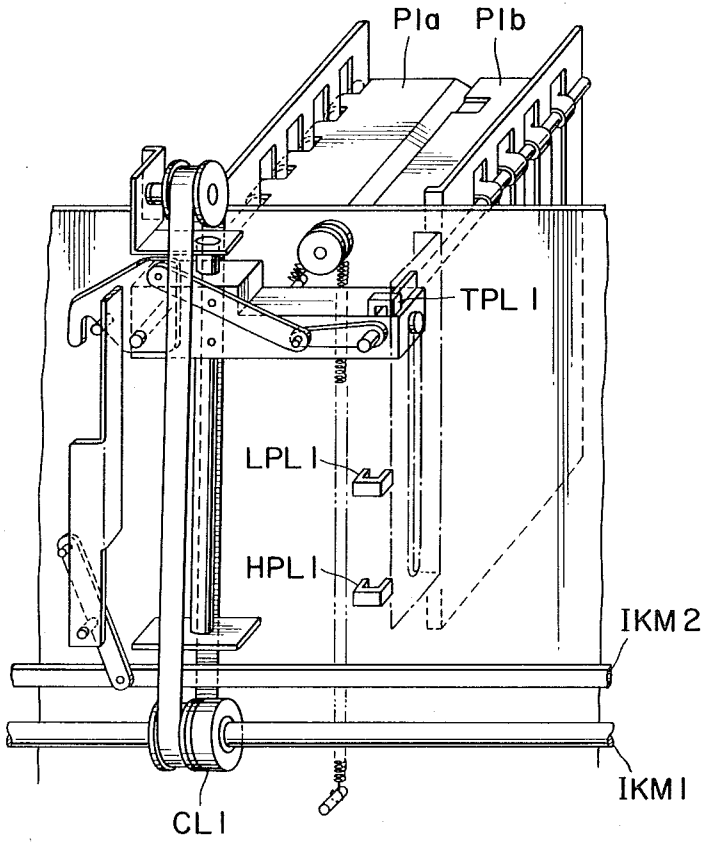

Namely, the supporting plates P1*a* to P6*a* and P1*b* to P6*b* are ordinarily kept horizontal (as indicated by a solid line) by a mechanism shown in FIG. 2. In contrast, when these supporting plates are lowered, they are opened laterally to allow the notes on receiving plates R1 to R6 of the containers to fall thereinto. The notes thus fallen are received and retained by the receiving plates R1 to R6. These receiving plates R1 to R6 are driven by a pulse motor TPM so that their positions are changed. First, they are located at a lower position and then lowered downwardly according to the amount of notes forced in. To control the positions of the receiving plates R1 to R6, sensors HEV1 to HEV6 are used. Namely, the receiving plates R1 to R6 activate a corresponding clutch or corresponding ones (of clutches TCL1 to TCL6) until the sensors HEV1 to HEV 6 do not sense the upper surfaces of the notes to move downwardly by the pulse motor TPM.

The seventh container S7 is provided for accommodating or receiving notes or the like which have been discriminated or determined to be abnormal at the discrimination unit 7. When the gate plate GB7 is operated, notes are accommodated into the container S7 via the conveyer system q. Further, the conveyer system d functions to hold or same notes subsequently sent after a predetermined number of notes are counted.

Figure 1B:
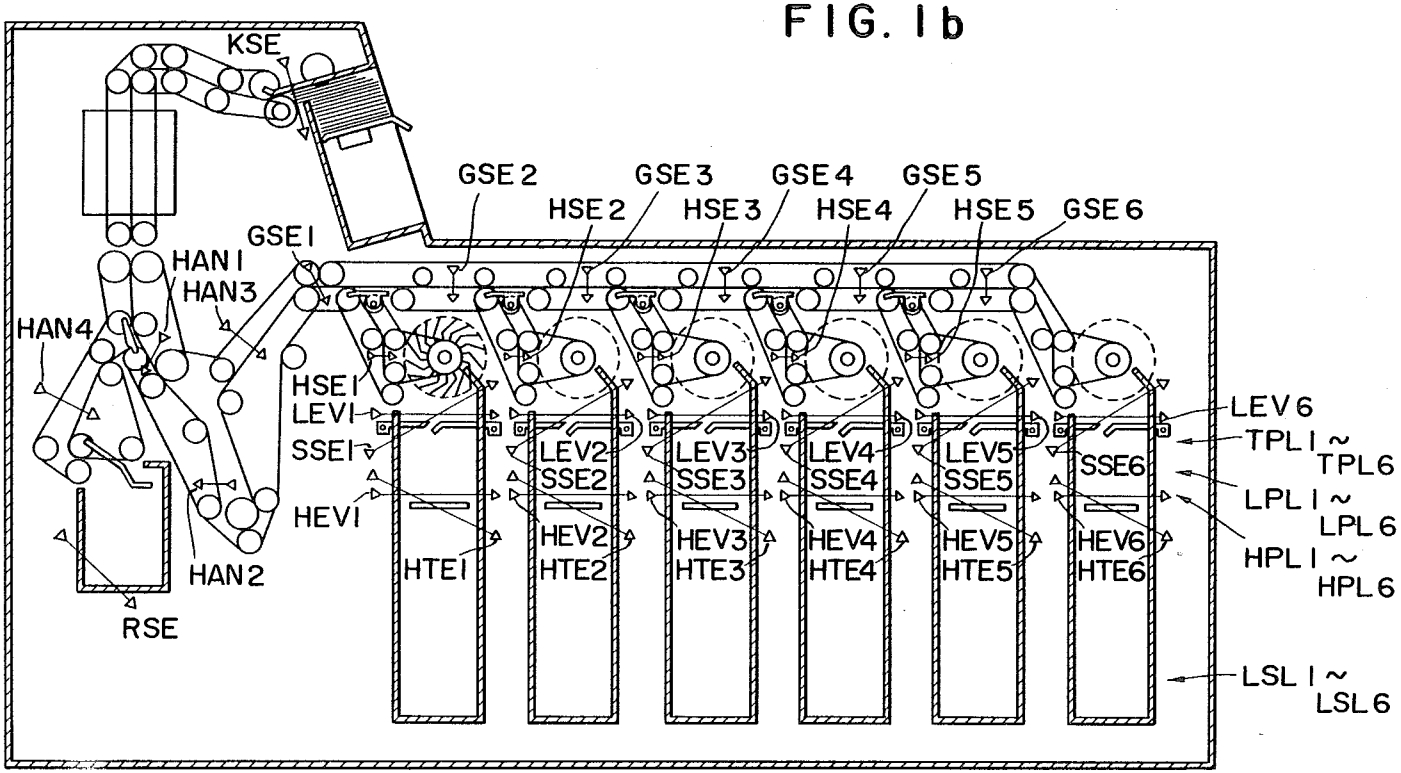

Various optical sensors will be described with reference to FIG. 1*b*.

A note detector KSE detects that notes placed on a mount 2 are collected by the draw-out roller 3 in a direction of the gate rollers 4 and 5. Light is radiated from the gate GX of the note insertion pocket 1 in the downward direction. On the other hand, the light radiated is received by a light-receiving device provided at the back side of the interior wall of the insertion pocket 1.

Sensors GSE1 to GSE5 provided in a sensor unit for driving the gates are provided for detecting top ends of notes conveyed to activate the gate plates GB1 to GB5 according to the kind of the notes.

Sensors HSE1 to HSE6 provided in a note passing sensor unit are provided for returning the gate plates GB1 to GB5 when they sense ends of the notes passed.

Sensors SSE1 to SSE6 provided in a reserved note sensor unit are provided for sensing notes stacked and accommodated in the temporary reserving units SH1 to SH6 of the first to sixth containers S1 to S6 to sense notes supported by the supporting plates P1*a* to P6*a* and P1*b* to P6*b*.

Sensors HEV1 to HEV6 are provided for controlling positions of the receiving plates R1 to R6 to produce signals to lower receiving plates R1 to R6 unit upper surfaces of the notes mounted on the receiving plates R1 to R6 are sensed.

Sensors HTE1 to HTE6 sense that notes mounted on the receiving plates R1 to R6 are present or absent.

Sensors HAN1 to HAN3 sense that notes in the conveyer system d are present or absent. A sensor HAN 4 senses passing of notes to be accommodated into the seventh containers S7 to return the gate plate GB7.

A sensor RSE senses that notes in the container S7 are present or absent.

Sensors LEV1 to LEV6 sense downward positions of the supporting plates P1*a* to P6*a* and P1*b* to P6*b* when separate plates are inserted.

Sensors TPL1 to TPL6, LPL1 to LPL6 and HPL1 to HPL6 will be described with reference to FIG. 2.

Sensors LSL1 to LSL6 sense the lowest positions when the receiving plates R1 to R6 are lowered to stop the downward movement thereof. These sensors are also utilized for sensing that temporary reserving units are completely filled with notes.

Figure 1C:
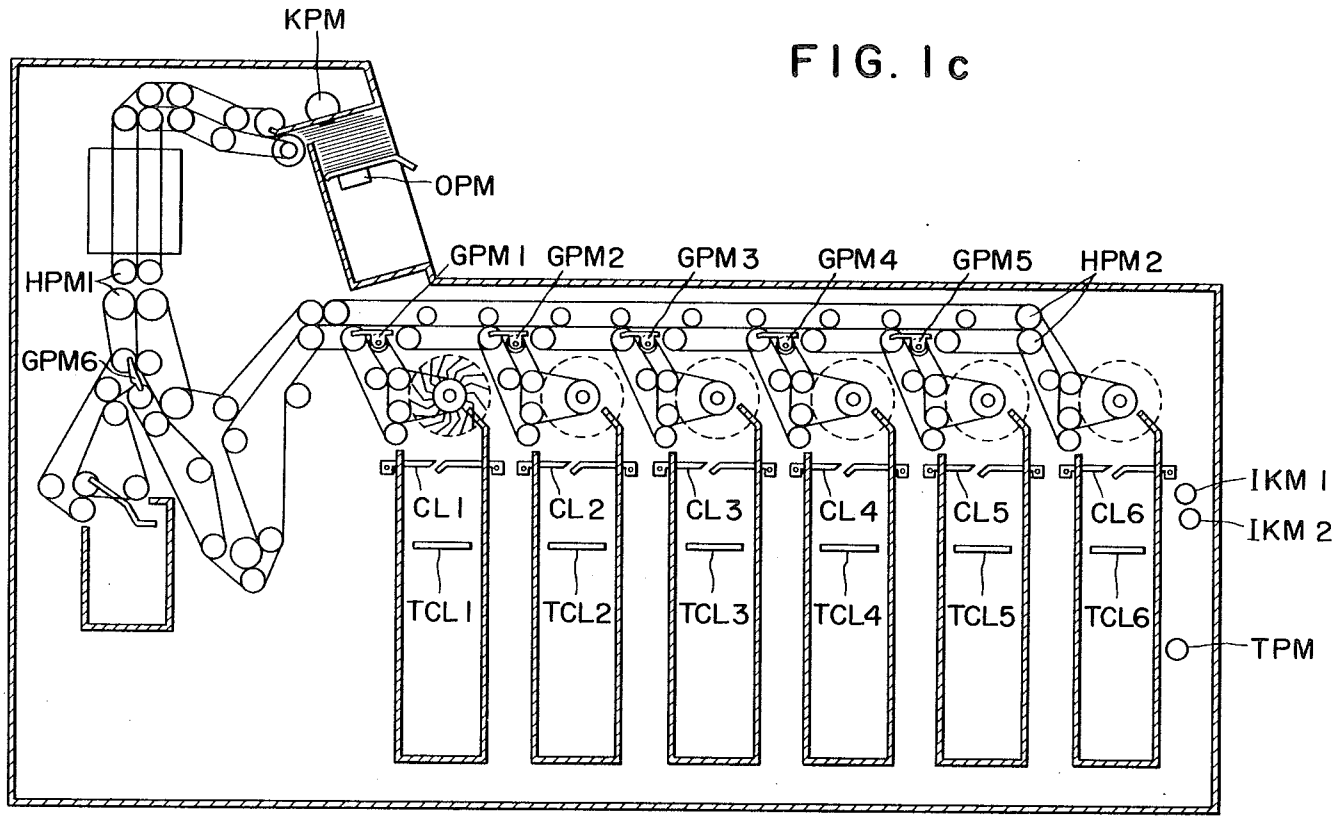

Then, various drive sources will be described with reference to FIG. 1*c*.

A draw-out unit is provided for intermittently rotating the draw-out roller 3 by the pulse motor KPM to send out notes one by one. The draw-out unit is configured so that a gate roller 4 also rotates during rotation of the draw-out roller 3.

The conveyer unit MPM rotationally drives belt (of which entirety is denoted by reference numeral 6) up to the conveyer system a to q by the conveying drive motors HPM1 and HPM2. The impellers HA1 to HA6 are rotationally driven in synchronism with the belt 6. To realize this, they may be driven by the conveying drive motor 2 or by another motor.

A gate drive unit comprises rotary solenoids or pulse motors GPM1 to GPM6 to effect switching drive of the gate plates GB1 to GB6.

A container drive unit comprises pulse motors IKM1, IKM2 and TPM to drive the receiving plates R1 to R6 and the supporting plates P1*a* to P6*a* and P1*b* to P6*b* in a vertical direction. In this instance, the supporting plates P1*a* to P6*a* and P1*b* to P6*b* are lowered by the motor IKM1, and opened and closed by the motor IKM2. Clutches CL1 to CL6 are coupled when the individual supporting plates P1*a* to P6*a* and P1*b* to P6*b* are driven downwardly as shown in FIG. 2.

Further, clutches TCL1 to TCL6 drive the receiving plates R1 to R6, respectively.

Figure 3:
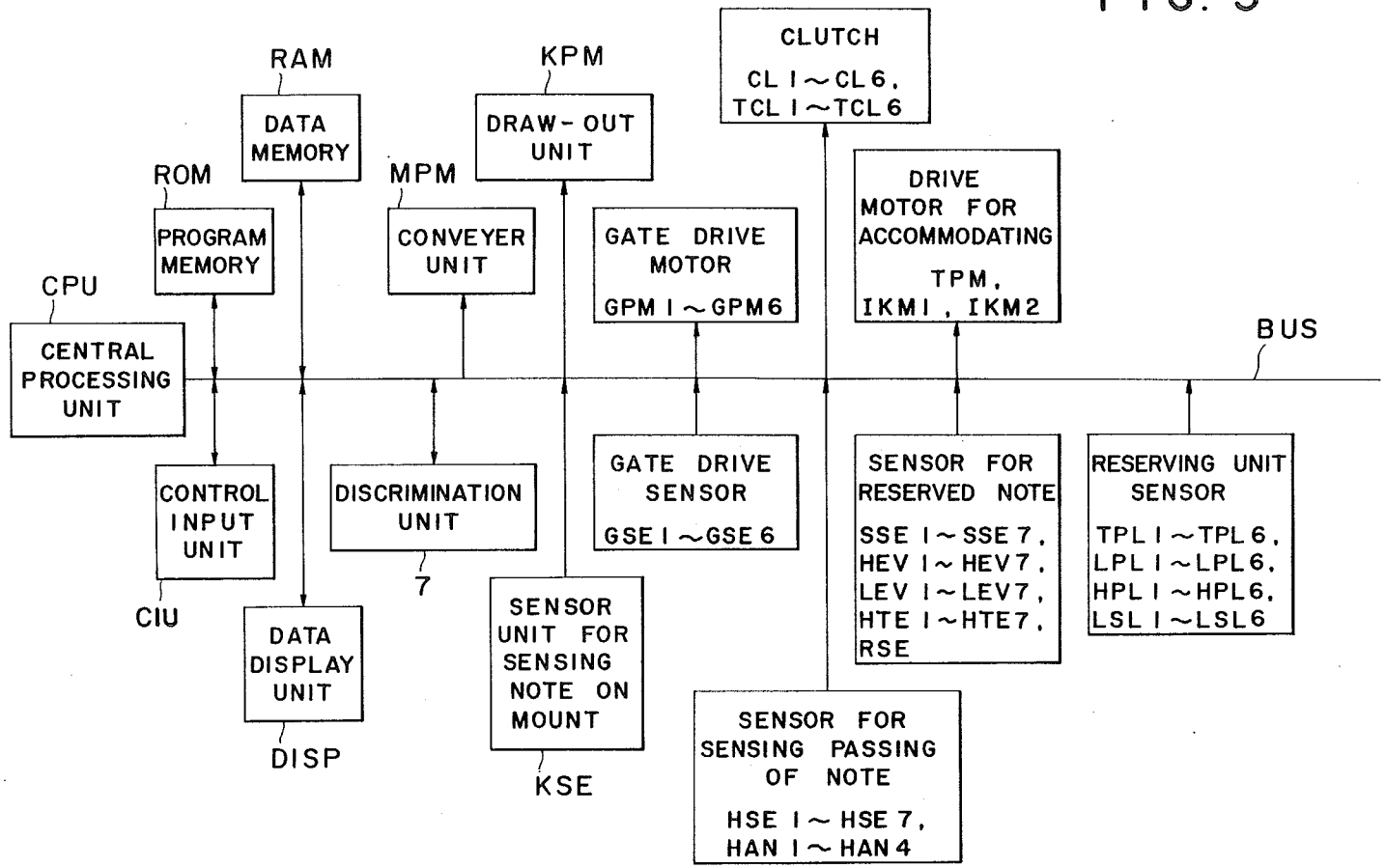
FIG. 3 is a block diagram illustrating a control system.

FIG. 3 shows a control system for a note sorting and counting apparatus according to the present invention.

A central processing unit CPU operates in accordance with a program stored in a program memory ROM to control the entirety of the note sorting and counting apparatus to store various data and flags in a data memory RAM according to need. A memory area within the data memory RAM will be referred to later with reference to FIG. 5.

A control input unit CIU is used to input various data and operational instructions, etc. when the counting apparatus is used. This control input unit will be described later in detail with reference to FIG. 4.

A data display unit is used to display various count data and denomination data, etc.

The discrimination 7, the conveyer unit MPM, the draw-out unit KPM, the gate drive units GPM1 to GPM6, the clutches CL1 to C6, the container drive unit TPM, the unit KSE for sensing notes on the mount, gate drive sensors GSE1 to GSE6, the sensors HSE1 to HSE7 for sensing passing of notes, reserved note sensors SSE1 to SSE7 have been previously described with reference to FIG. 1. These components are connected to the central processing unit CPU through a bus line BUS.

Figure 4:
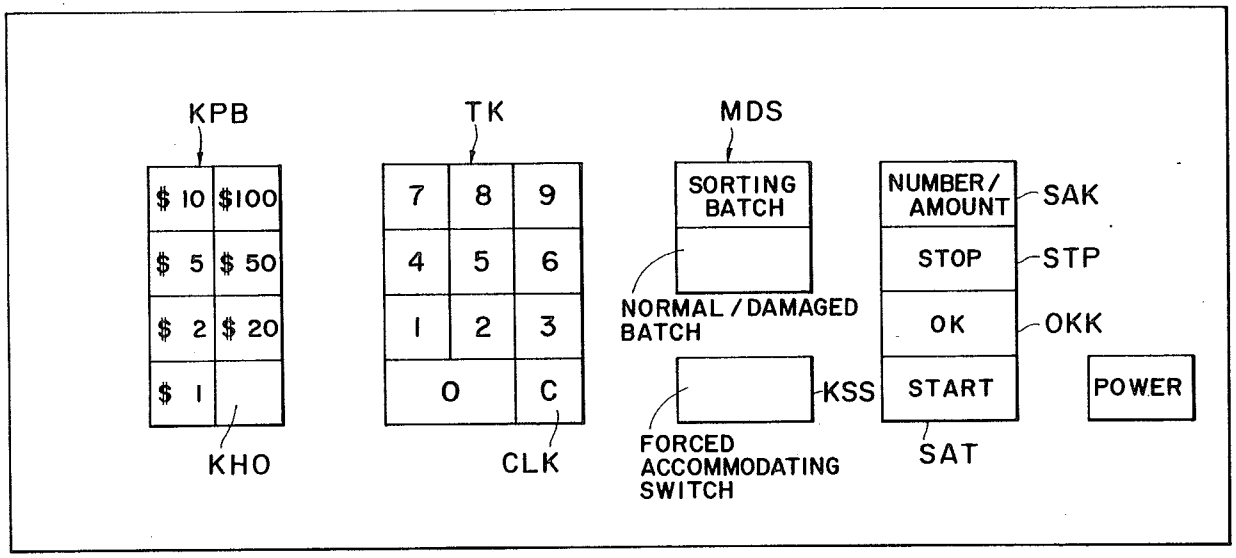
FIG. 4 is a front view illustrating an operating input unit.

The control input unit CIU will be now described with reference to FIG. 4.

A denomination key KPB is provided to designate the denomination range from 1 to 100 dollers.

A denomination judging or determining "off" switch KHO is provided to inhibit the denomination judgement processing in the discrimination unit. Instead of this, it may be configured that even if the denomination judgement processing is carried out, the CPU does not process a signal produced thereby as a denomination signal.

A ten key TK comprises keys "0" to "9". A clear key CLK is used for clear of an input from the ten key TK.

A mode switch MDS is used for selective designation of mode. With this mode switch MDS, a classification batch and normal/damaged batch can be selected. In addition, by effecting selective designation of the denomination batch, the normal/damaged batch can be selected. Various modes as shown in the Table of FIG. 6 are provided.

A switch SAK is operated when the count value of the notes is changed to the money value and the value thereof is displayed. This switch SAK is used when both the number of notes and the money value corresponding thereto are displayed by a common indicator provided in the data display unit. A stop key STP is used to stop the sorting processing when pushed down. This stop key is used when the conveyer system is clogged with notes or in the similar case.

An OK key OKK is used to when notes in the temporary reserving unit onto the receiving plates is transferred.

A start key SAT is pushed down when the counting apparatus is started by the manual operation. Instead of initiation by the start key SAT, a method may be employed to sense that notes are placed on the mount 2 by using the sensor KSE to automatically start the counting apparatus.

Figure 5:
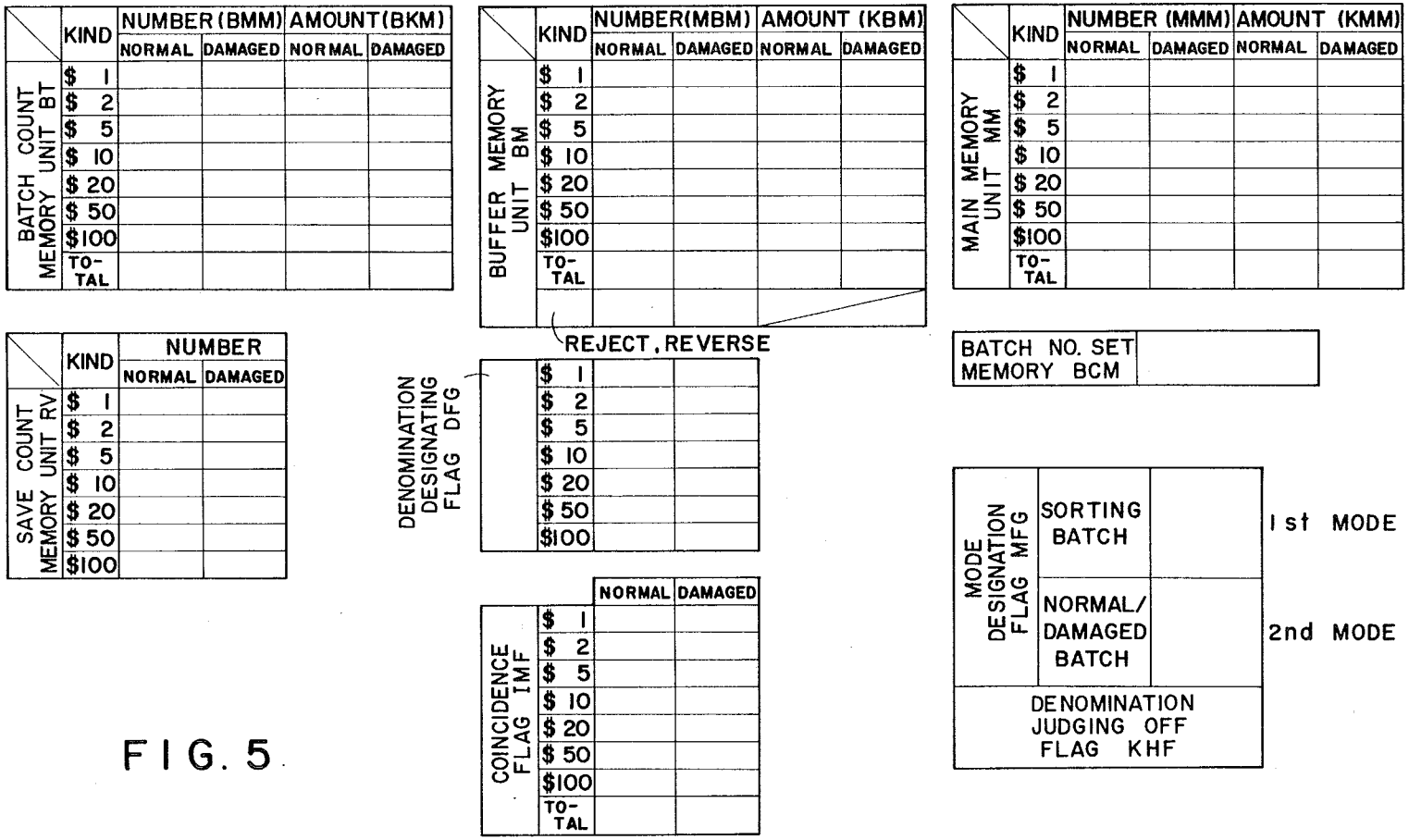
FIG. 5 is an explanatory view showing memory areas of data memory.

A memory area of the data memory RAM will be described with reference to FIG. 5.

A buffer memory unit BM stores the number (MBM) of notes and the money amount KBM per each lot according to denomination from 1 to 100 dollars and the total thereof according to the condition i.e. whether they are normal or damaged, and stores the number of reject notes. The reject notes stated above include not only notes of abnormal thickness, chain, oblique displacement and breakage but also reversed notes.

Main memory unit MM stores accumulated value of the money amount (KMM) in respect to the respective denominations from 1 to 100 dollars and the total thereof according to the condition where they are normal or damaged, respectively. Namely, when the OK key is pushed down upon completion of one slot, the contents of the buffer memory units are added. When this addition is performed, the buffer memory unit is cleared.

A batch count memory unit BT stores a count value at the time of batch processing.

A saving count memory unit RV stores data in respect to notes which have been discriminated subsequent to the notes subject to equalizing operation between the count value and the setting value (therefore, are reserved in a saving path) because of the fact that when the count value is equal to the setting value, notes already have been drawn out.

Denomination designation flags DFG are provided. When a denomination is designated by the denomination key KPB, a flag corresponding to the designated denomination represents "1" (other flags remains "0").

Mode designation flags MFG are provided. When a mode is designated by the mode switch MDS, a flag corresponding to the designated mode represents "1".

A batch number set memory BCM is provided. At the time of the batch mode (the sorting batch and normal and damaged batch), this memory BCM stores the number of batches input by the ten key TK.

A denomination judgement or determination inhibit flag KHF is provided. When the denomination judgement off switch KHO is pushed down, this flag KHF is set.

Coincidence flags IHF are provided. When the equality of the number of batches is performed in connection with anyone of kinds (denomination, normal/damaged) at the time of the batch processing, a flag corresponding to the kind represents "1".

The operation of the above-mentioned count will be described with reference to FIGS. 7 to 11.

Figure 7:
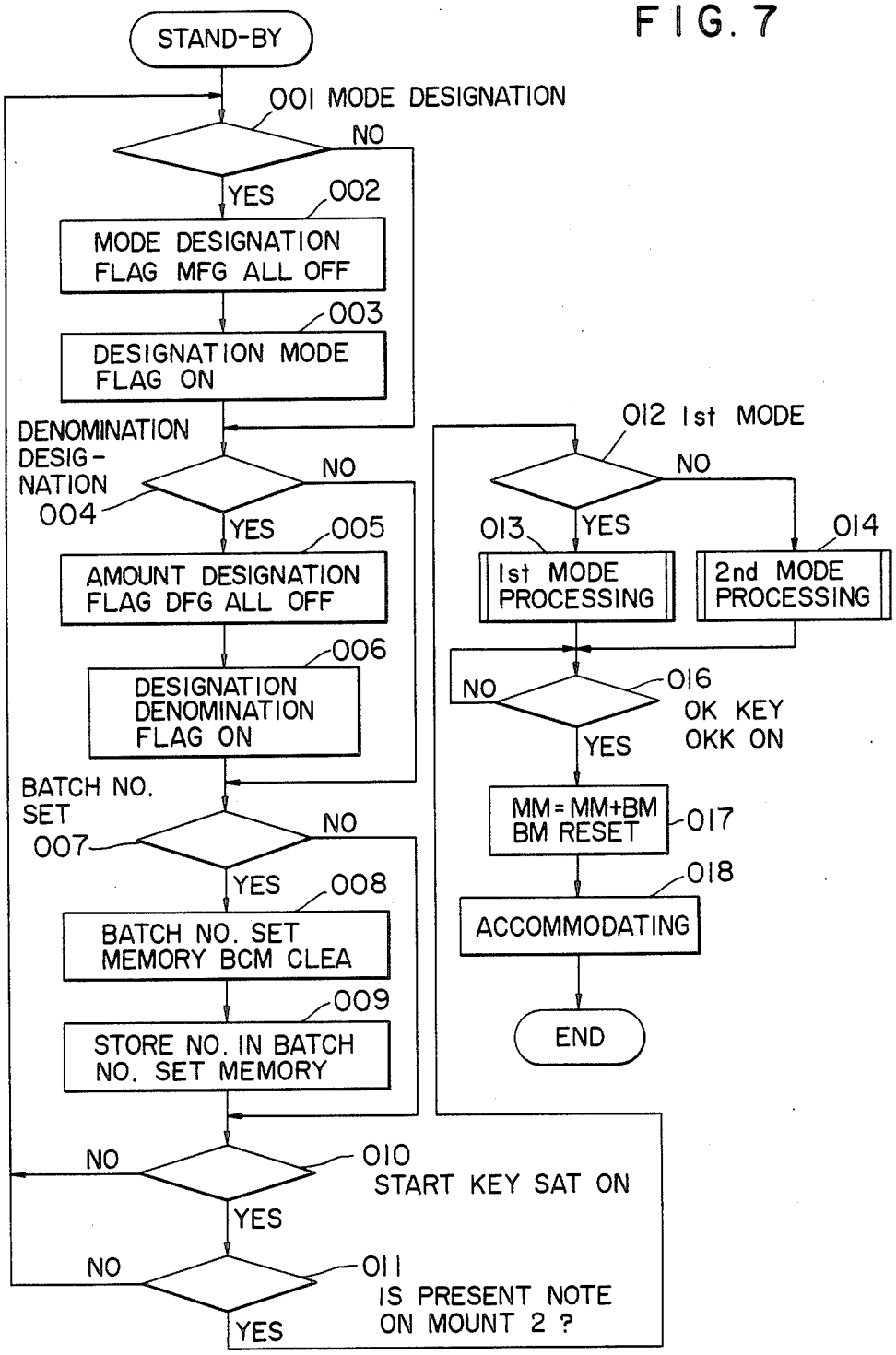
FIG. 7 is a flowchart showing the operation of a note sorting and counting apparatus.

FIG. 7 shows a series of operations including the input processing, the sorting processing and accommodating or transfer processing.

Initially, these operations are briefly described.

Steps 001 to 003 denote a mode designation processing, steps 004 to 006 a denomination designation processing, steps 007 to 990 a bath number designation processing, steps 010 to 011 a start command processing, steps 012 to 014 a sorting count processing at each mode (shown in FIGS. 8 and 9), and steps 016 to 018 an adding and accommodating or transferring processing.

These steps will be described in order.

The sorting batch and the normal/damaged batch are input by using the mode switch (step 001). For instance, when the "sorting batch" is designated, the mode designation flags MFG of the RAM are all set to "0" (step 002), thereafter to set the flag of the "sorting flag" designated to "1" (step 003). A plurality of modes cannot be designated at the same time, When the mode is not designated, i.e., when the mode previously designated is continued, the operation advances from the step 001 to the step 004.

Then, when the denomination is designated by the denomination key KPB (step 004), the denomination designation flags DFG are all set to "0" (step 005) to set the flag of the designated denomination, e.g. 10 dollars to "1". This denomination designation processing is effective only when the normal/damaged mode and the normal/damaged batch mode are designated. When the denomination is not designated, the operation shifts to the step 007.

When there is a need for predetermined number division processing (batch processing), the number thereof is input by using the ten key TK. When the number of batches is input (step 007), the contents of the batch number set memory BCM are cleared (step 008), thereafter to store the numeral which has been input (step 009). When the batch number is not input (step 007), the operation shifts to the step 010. This batch number is also effective is that only the sorting batch mode and the normal/damaged batch mode are designated.

Then, a judgement or determination as to whether the start key SAT is pushed down or not is made (step 010). When not pushed down, the operation returns to the step 001 to repeatedly execute the steps 001, 004 and 007 until the start key is pushed down. In the configuration stated above, where there is a need to correct the operation previously input, a correction key is pushed down without pushing down the start key SAT, thereby making it possible to change the instruction.

When the start key SAT is pushed down, a judgement or determination as to whether there are notes on the mount 2 is made (step 011). Namely, a judgement as to whether the sensor KSE, provided in the sensor unit for sensing notes on the mount, senses the notes or not is made. Where there is no note, start operation is not conducted even when the start key is pushed down. In contrast, when there are notes, the draw-out unit KPM and the conveyer unit MPM are operated. Namely, a determination as to whether "1" is set to which bit of the mode designation flag MFG or not is made (step 012) to execute the first mode processing (step 013), and the second mode processing (step 014) according to the designated mode. The first mode represents the sorting batch mode and the second mode the normal/damaged mode. Upon completion of the execution of the first and second modes, after the OK key OKK is pushed down (step 016), the count data in the buffer memory unit BM is added to the data in the main memory unit MM. The sum thus obtained is stored in the main memory unit MM. Subsequently, the buffer memory unit BM is reset (step 017). The contents of the main memory unit MM are displayed on the display unit, etc. Thereafter, notes are accommodated (step 018). Such an accommodating operation is carried out by executing the steps shown in FIG. 10 in respect to the all containers S1 to S7.

Figure 8A:
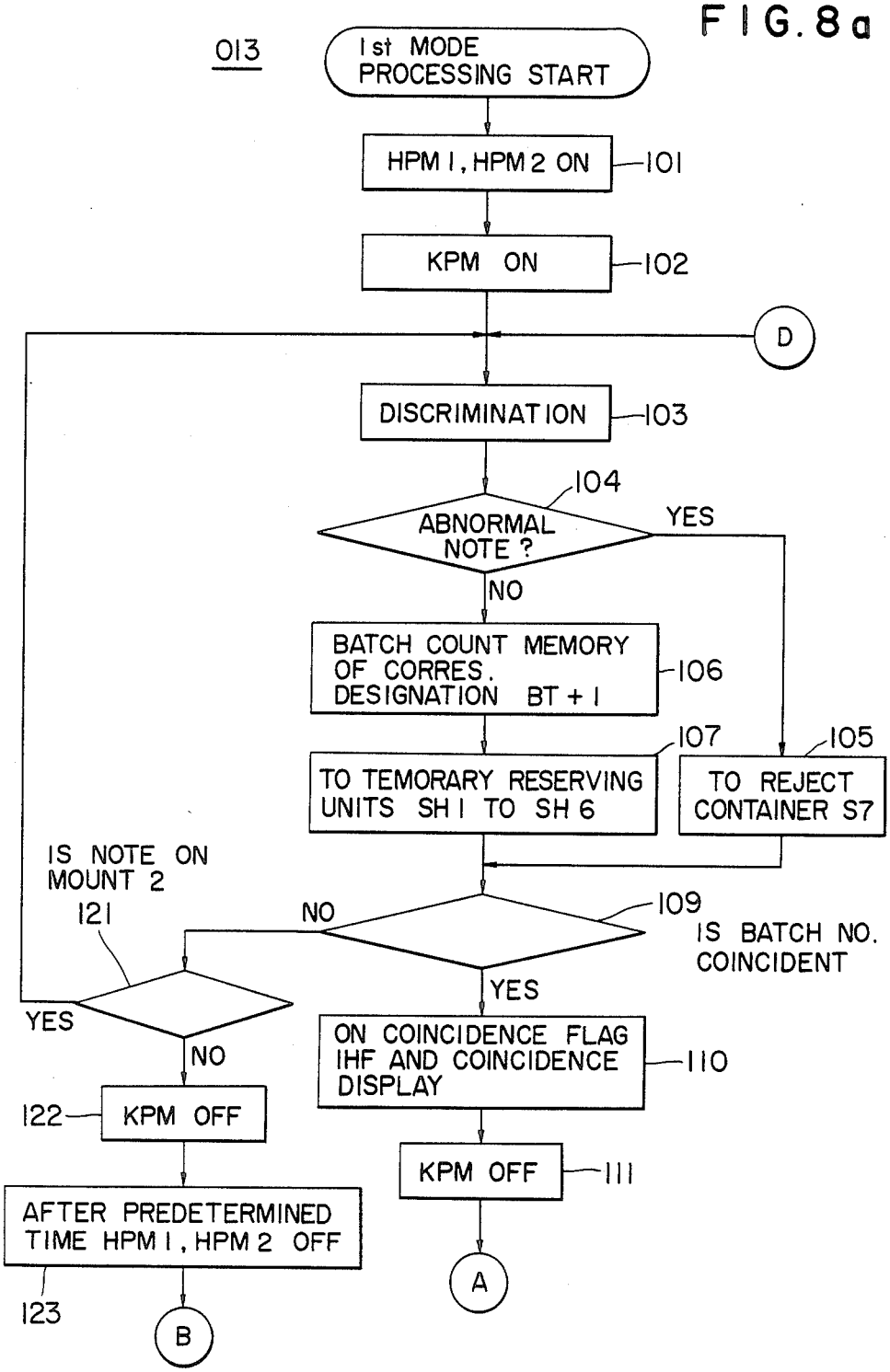
FIGS. 8*a*, 8*b* and 8*c* are flowcharts showing the operation based on a first processing mode.
Figure 8B:
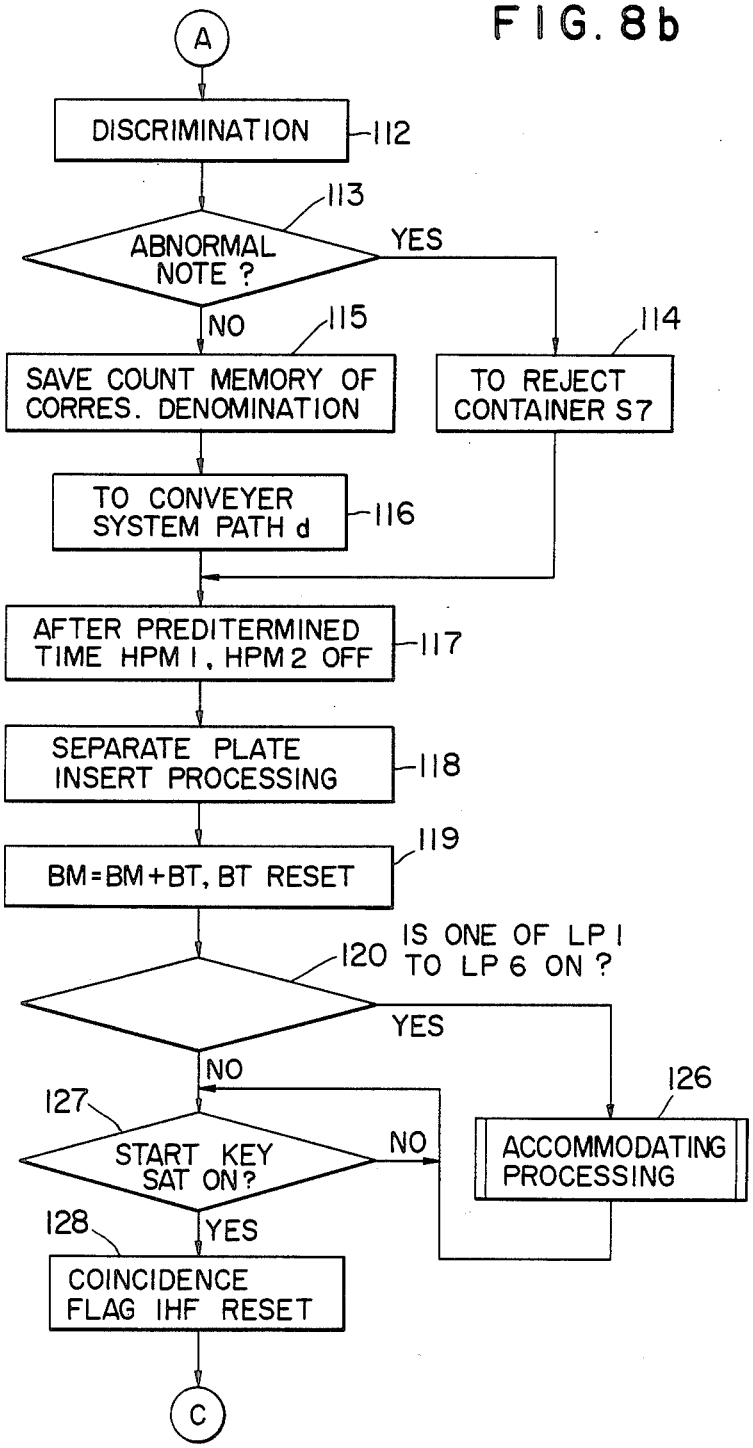
Figure 8C:
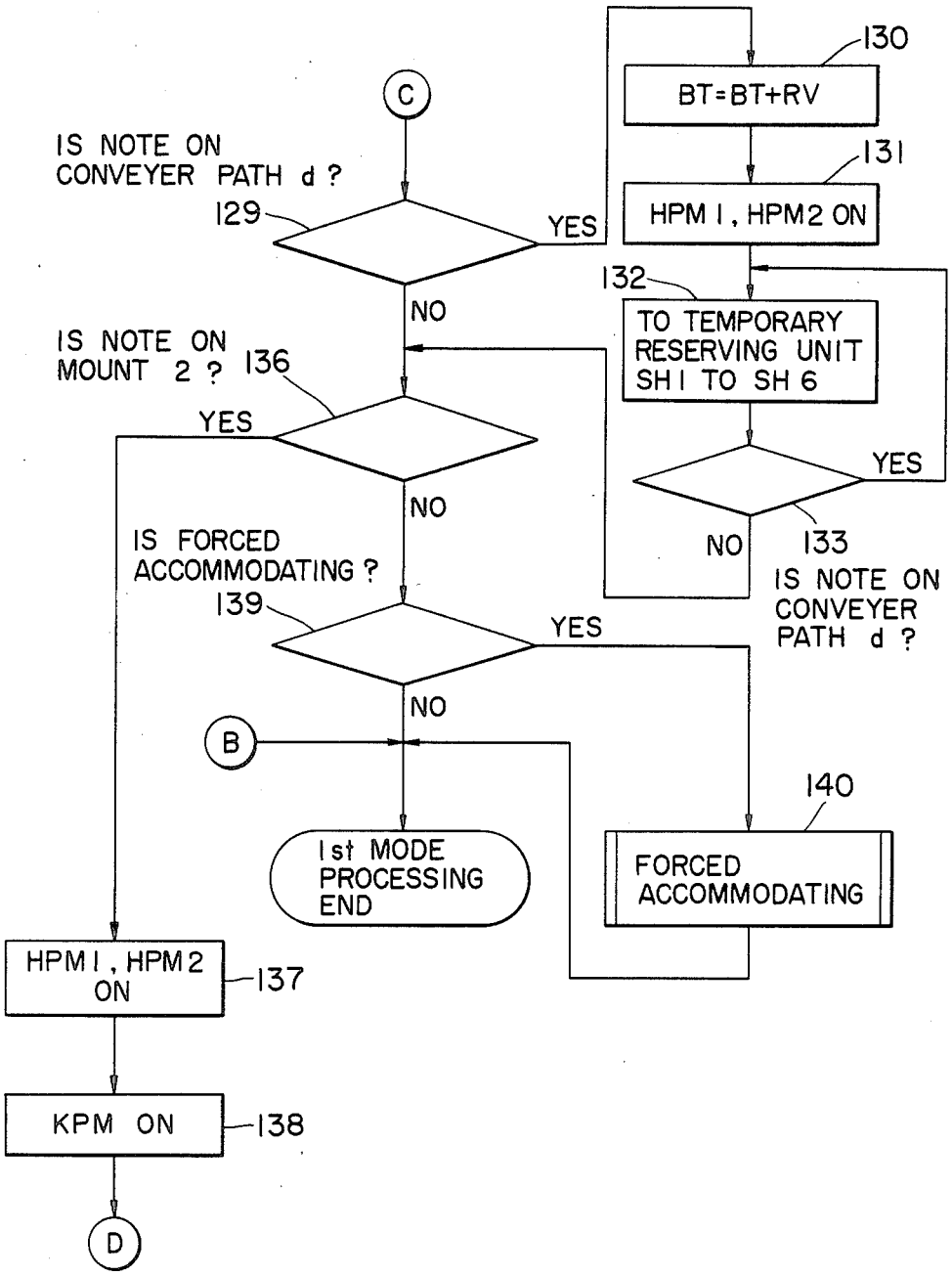

Then, the first mode processing (the sorting batch mode) of the step 013 shown in FIG. 7 will be described with reference to FIGS. 8*a* through 8*c*.

Initially, the conveyer drive motors HPM1 and HPM2 are driven (step 101). Thereafter, the pulse motor KPM is driven (step 102).

The draw-out roller 3 draws out only one note located at the lowest position from the stacked notes placed on the mount 2 in a direction of the gate roller 4 to convey the note thus drawn out to the conveyer belt 6. The discrimination unit 7 discriminates the notes conveyed (step 103) truth or falsity, denominations, the obverse or reverse, thickness, chain, oblique displacement and breakage (normal/damage conditions is not discriminated here). When reverse orientation, abnormal thickness, chain, oblique displacement and/or breakage is detected (step 104), the gate plate GB7 is switched by the motor GB7 provided in the gate drive unit. These notes are determined to be abnormal and then are conveyed to the seventh container S7 (reject pocket) (step 105).

In contrast, when notes are judged to be normal, 1 is added to the number stored in the batch count memory unit BT of the denomination designated (step 106). (In this instance, since the discrimination as to whether notes are normal/damaged is not carried out, either of memory areas e.g. the memory area for "normal note" is used.) Notes of a predetermined denomination are transferred to the temporary reserving units SH1 to SH6 of the containers S1 to S6 (step 107). For instance, respective containers S1 to S6 are adapted to recline notes according to the denomination of note as shown in column A of FIG. 6. Assuming that notes of 10 dollars are used, when the sensor GSE4 provided in the gate drive sensor unit senses the top end of the notes of 10 dollars, the motor GPM4 of the gate drive unit is operated to rotate the gate plate GB4 in a right-hand direction to convey the notes of 10 dollars towards the conveyer system n to accumulate them in a horizontal condition or stack by means of the impeller HA4.

Then, a judgement or determination as to whether the content of the batch number set memory BCM is equal to the data of number in the batch count memory unit BT of the concerned denomination (in regard to the notes discriminated) or not is made (step 109). In this instance, in connection with other denominations, the judgement of the correspondence is not carried out. When the correspondence therebetween does not hold, a judgement or determination as to whether notes are placed on the mount 2 or not by using the sensor unit KSE for sensing notes on the mount is made (step 121). As a result, when notes are present, the operation returns to the step 103 to continue drawing out of notes.

When the mount 2 becomes vacant, the pulse motor KPM is stopped (step 122), to stop the conveyer drive motors HPM1 and HPM2 in a predetermined time. A time required until the final note is securely sorted is set for the above-mentioned predetermined time. Thus, the first mode is completed.

On the other hand, when the coincidence holds in connection with the batch number, the coincidence flag IHF of the concerned denomination is set to "1" to effect coincidence display. Namely, a corresponding coincidence indication lamp (not shown) is lighted (step 110). Thus, the pulse motor KPM is stopped once to stop drawing out of notes (step 111).

After the motor KPM is stopped, the notes which have been already drawn out are still conveyed to pass through the discrimination unit 7. Accordingly, the discrimination unit effects discrimination of the notes (step 112). A judgement as to whether the notes are abnormal or not is made (step 113). As a result, when these notes are abnormal, they are guided to the reject container S7 (step 114). In contrast, when they are not abnormal, 1 is added to the content of the saving count memory RM of the corresponding denomination (step 115), and then they are guided to the conveyor path (step 116).

After a predetermined time elapses, the motors HPM1 and MPM2 are stopped (step 117). As a result, some notes (usually about three) are reserved in the stand-by or saving passage d. These notes are notes which are drawn out after the notes of which count coincidence has been established. At the next batch processing, they are accommodated or transferred into the corresponding containers S1 to S6, respectively.

After the motors HPM1 and HPM2 are stopped, an operator inserts by hand a separate plate or plates into the temporary reserving units SH1 to SH6 corresponding to the denomination or denominations designated by a lighted coincidence indicating lamp or lamps (step 118). In this instance, the clutches corresponding to the denomination or denominations of which count coincidence has been established are turned on to drive the motor IKM thereby to lower the supporting plates until the upper surfaces of the notes reserved on the supporting plates P1*a* to P6*a* and P1*b* to P6*b* do not screen the lights of the sensors LEV1 to LEV6 (the sensor of each corresponding denomination) i.e. to the about the supporting plate position in FIG. 1, thus facilitating the insertion of the separate plate. When the clutches CL1 to CL6 are cut off in response to the next start instruction, the supporting plates P1*a* to P6*a* and P1*b* to P6*b* rise by the spring force.

In regard to the denomination of which coincidence relation has been estalished, the data of the batch count memory unit BT is added to the data of the buffer memory unit BM. The sum thereof is stored in the buffer memory unit BM. Subsequently, the corresponding batch count memory BT is reset (step 119).

At the temporary reserving units SH1 to SH6 provided according to the denomination of note shown in FIG. 2, any supporting plates P1*a* to P6*a* and P1*b* to P6*b* are lowered by the notes accumulated and sensed by corresponding sensors (step 120). Thus, accommodating processing is carried out (step 126).

Figure 10:
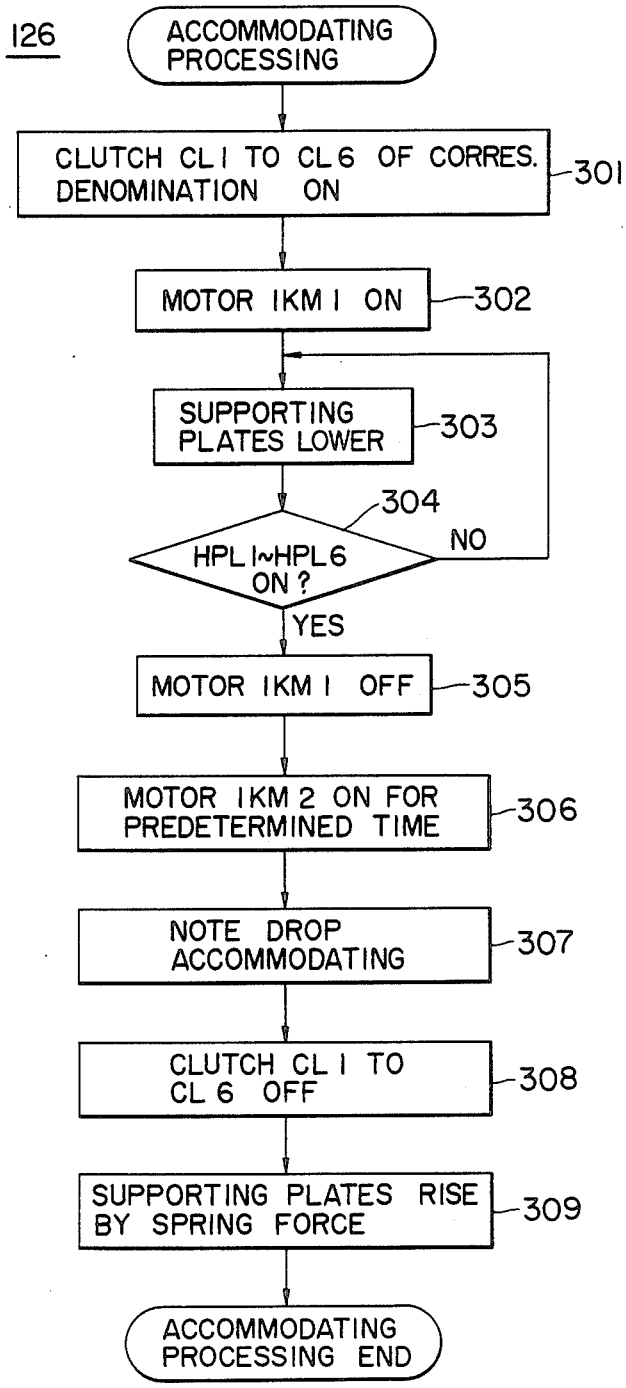
FIG. 10 is a flowchart showing the operation of an accommodating processing.

The accommodating processing in the step 126 will be described in detail with reference to FIG. 10.

In regard to the denomination detected, first is to turn on only corresponding one or ones of the clutches CL1 to C6 (step 301) to drive the motor IKM1 (step 302). Thus, the supporting plates P1*a* to P6*a* and P1*b* to P6*b* are lowered. When this downward movement is sensed by the sensors HPL1 to HPL6 (step 304), the motor IKM1 is stopped (step 305). Subsequently, the motor IKM2 is driven for a predetermined time interval (step 306) to shift the lever in a left-hand direction to open the supporting plates P1*a* to P6*a* and P1*b* to P6*b*, thus transferring the notes accumulated at that place onto the receiving plates R1 to R6 to accommodate them thereon (step 307). Then, the clutches CL1 to TL6 are cut off (step 308) to elevate the supporting plates P1*a* to P6*a* and P1*b* to P6*b* by the spring force. On the other hand, the sensors HEV1 to HEV6 are screened by the notes, the clutches TCL1 to TCL2 of corresponding denomination are turned on to drive the motor TPM to lower the notes until they are not sensed, thus allowing all the upper surfaces of the notes accumulated to be located at the same position.

Then, when the operator pushes down the start key switch SAT (step 127), the coincidence flat IHF is reset (step 128). Subsequently, a judgement or determination as to whether the notes are present or absent on the conveyer path (the stand-by path d) is made (step 129). As a result, when the notes are present, they are sorted and accommodated (steps 130, 131 and 132). Namely, the data of the batch count memory unit BT is added to the data of the saving count memory unit RV. The sum thereof is stored in the batch count memory unit RV (step 130). Subsequently, the conveyor drive motors HPM1 and HPM2 are driven (step 131), thus accommodating the notes on the stand-by path or saving d into the temporary reserving units SH1 to SH6 provided according to the denomination of note (step 132). When it is confirmed that the stand-by passage becomes vacant, the operation advances to the step 136.

Subsequently, a judgement or determination as to whether notes are present on the mount 2 or not is made (step 136). As a result, when the notes are present on the mount 2, the conveyer drive motors HPM1 and HPM2 are driven (step 137). Then, the motor KPM is driven (step 138). Thus, the operation shifts to the step 103 to continue the count.

On the other hand, when there is no note on the mount 2 (step 136), a judgement as to whether forced accommodating or transferring operation is required or not (step 139). As a result, when the forced accommodating or transferring operation is required, the forced accommodating processing is carried out (step 140). The forced accommodating or transferring processing is used for forcedly accommodating the notes rejected in the steps 105 and 104 into the respective containers S1 to S6. The operator takes out the reject notes from the seventh container S7 to sort them according to the denomination of note by the eye (when forged notes are present, they are removed) to insert them into the insertion pocket 1 per each denomination of note to push down the forced accommodating switch and to designate the denomination of note, thus forcedly accommodating or transferring them into the container of the corresponding note denomination. Since the reverse notes are excluded as "abnormal notes" in the steps 104 and 113, it is required to accommodate or transfer them from the reject container S7 to the respective containers S1 to S6 provided according to the denomninations of the notes. Furhter, since notes of chain, abnormal thickness and obliquely displacement are true notes in substance, they are forcedly accommodated.

FIG. 11 shows the control operation when notes are forcedly accommodated or transferred. First, a determination is made as to whether the forced accommodating switch KSS is pushed down or not in the step 401. As a result, when the forced accommodating or transferring switch KSS is pushed down, the forced accommodating flag is turned on (step 402). Then the gate plates GPM1 to GPM5 of the corresponding denomination of note are switched (step 404). After the start switch SAT is pushed down (step 405), the motors HPM1 and HPM2 and the motor KPM are turned on (steps 406 and 407) to effect discrimination as notes pass through the discrimination unit 7 (step 408). In the step 409, a judgement or determination as to whether notes are abnormal or not is made. As a result, when the notes are abnormal, they are guided into the reject container S7 (step 410). In contrast, when they are not abnormal, 1 is added to the content of the buffer memory BM of the designated denomination of note (step 411) to guide them into the temporary reserving unit provided according to the denomination of note (step 412). The above-mentioned operation (steps 408 to 412) proceeds until there is no note on the mount 2 (step 413). When the mount 2 becomes vacant, the motor KPM is switched off (step 414). Subsequently, after a predetermined time elapses, the motor HPM1 and HPM2 and the gate (one of GPM1 to GPM5) which has been operated is switched off (step 415).

Then, the operation returns to the step 401. When it is detected that the receiving switch OKK is pushed down in the step 416, the forced accommodating flag is turned off (step 417). Thus, the forced accommodating processing is completed.

During the above-mentioned forced accommodating processing, a method may be employed to collectively insert all the reject notes into the insertion pocket 1 to draw out them to perform the judgement in regard to the denomination of note in the discrimination unit to exclude all the notes except for the one corresponding to the designated denomination of note.

Figure 9:
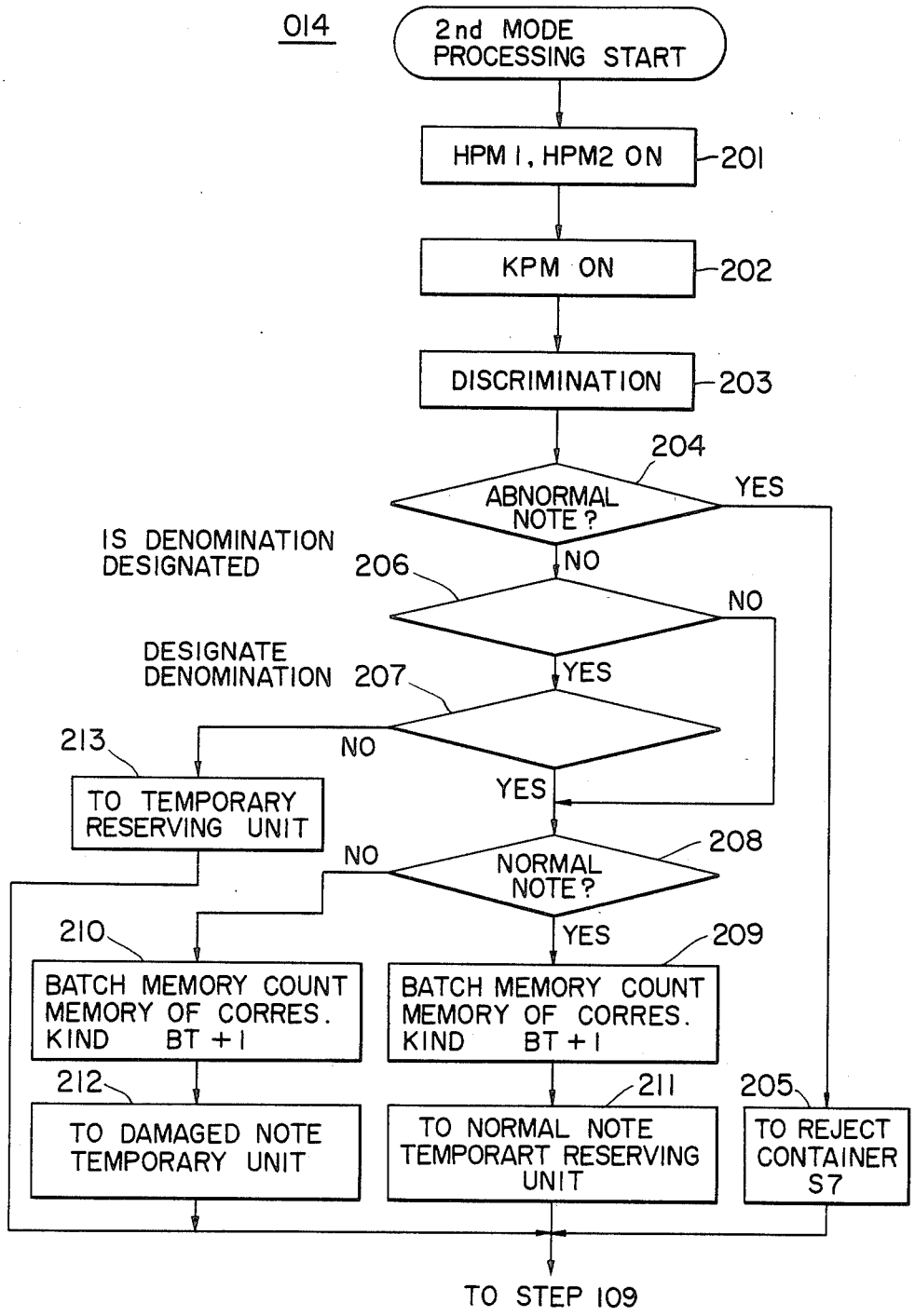
FIG. 9 is a flowchart showing the operation based on a second processing mode.

Then, the second mode processing (normal/damaged mode and the normal/damaged batch mode) of the step 014 in FIG. 7 will be described with reference to FIG. 9.

When the conveyor drive motors HPM1 and HPM2 are driven (step 101) and the pulse motor KPM is driven, the draw-out roller 3 draws out only one note located at the lowest position from the accumulated notes placed on the mount 2 in a direction of the gate roller 4 to convey them by means of the conveyor belt. The discrimination unit 7 discriminates the notes thus conveyed (step 203). Assuming now that the normal/-damaged mode is designated, the discrimination unit 7 discriminates the notes in regard to normal or damaged, truth or false, denomination of note, obverse or reverse, thickness, chain, oblique displacement and breakage, etc. When reverse, abnormal thickness, chain, oblique displacement or breakage is detected in connection with the notes conveyed, they are judged to be abnormal (step 204) and conveyed to the seventh container S7 (the reject pocket) (step 205).

When the note is normal, next is to make a judgement or determination as to whether the denomination of note is designated or not by making reference to the flag DFG indicative of the denomination of note (step 206). When the designation of note is designated, next is to make a judgement as to whether the concerned note corresponds to the designated denomination of the note by making reference to the discrimination result in the step 203 (step 207). In the case of the designated denomination of note, a judgement or determination as to whether the note is normal or damaged is made in the step 208 to add 1 to the number of the corresponding batch count memory unit BT according to the normal note or the damaged note, respectively (steps 209 and 210) to guide them into the temporary reserving unit of the normal container and the temporary reserving unit of the damaged container, respectively (steps 211 and 212). In contrast, notes in other denominations are guided into the temporary reserving unit of a different denomination container (step 213).

When it is judged that the denomination of note is not designated in the step 206, 1 is added to the content of the batch count memory unit BT according to the normal note or damaged note (irrespective of the denomination of note), respectively (steps 209 and 210) to guide them into the corresponding containers (steps 211 and 212).

The memory area of the batch count memory unit BT used in the steps 209 and 210 corresponds to the normal and damaged memory areas of the designated denomination of note when the denomination of note is designated, and corresponds to the memory areas of the total when the denomination of note is not designated.

The allocation of the containers S1 to S7 is indicated by column B (when the denomination of note is not designated) and column C (when the denomination of note is designated) in FIG. 6.

For instance, in the case of the obverse of the normal note (when the denomination of note is designated, the note is limited to the designated designation), when the sensor GSE4 or GSE5 of the gate drive sensor unit senses the top of the note, the motor GPM4 or GPM5 of the gate drive unit is activated to rotate the gate plate GB4 or GB5 as indicated in dotted lines to convey the notes in the direction of the conveyer system n or o to accumulate them in a horizontal condition or stack by means of impeller HA4 or HA5. In the above-mentioned allocation or transfer, two containers are allotted to the same kind. When one container is filled with notes, such an allocation or transfer makes it possible to use the other container.

The operation subsequent thereto is the same as that in the steps 109 to 140 in FIG. 8. The former is different from the latter only in that notes are guided into the containers provided according to the normal/damaged notes instead of guiding them into the containers provided according to the note denominatin.

In the above-mentioned embodiment, it has been described that every time notes are drawn out, "number of notes" of the corresponding kind are updated in the buffer memory unit and the main memory unit of the data memory RAM. In this embodiment, "denomination of note" is also automatically updated. The number of notes and the denomination of notes of the total are updated together. Further, when the data of the buffer memory unit is added to the content of the main memory unit, not only number of notes but also the amount of money are added.

As stated above, the note sorting and counting apparatus according to this embodiment is configured so that notes of the denomination filled in the temporary reserving unit will be immediately received and accommodated in the container, with the result that there is no need for an operator to give each an accommodating or transferring instruction. Moreover, the apparatus of this embodiment makes it possible to accommodate notes of all denominations into the containers when a cycle of processing is completed or in the similar case, allowing this apparatus to be useful.

Further, the apparatus of this embodiment functions to discriminate notes drawn out after the set value is reached i.e. the notes in the saving passage. Accordingly, there is little possibility that normal notes are conveyed to the reject unit, resulting in improved count efficiency. Moreover, this minimizes the possibility that the reject unit becomes filled with notes, to conserve the labor of an operator.

Furthermore, the apparatus of this embodiment can sort the notes rejected once according to the denomination of note and thereafter designate the denomination of note to forcedly transfer the notes to the correct container. When such an operation is performed, this apparatus makes it possible to count the number of notes. Accordingly, this apparatus is useful in that there is no need to count the number of notes of the denomination rejected by hand.

The arrangement or order of the first to seventh containers S1 to S7, the configuration of the temporary reserving unit, the shape of the supporting plates, the receiving plates, the pushers and the separate pieces, and the like are not limited to those in the abovementioned embodiment.

In the above-mentioned embodiment, the seventh container S7 is assigned to the reject notes. Since it is supposed that the number of reject notes is relatively small, the seventh container S7 is configured as a container having a small capacity. However, this container S7 may be configured like the first to sixth containers.

In addition, since the number of issuance and circulation of the two dollar note is extremely small, this note is sorted (but independently counted on the data memory) as the abnormal note. If necessary, a container for the two dollar note may be additionally provided.

What is claimed is:

1. A note sorting and counting apparatus comprising:
- a draw-out unit for drawing out notes in succession from a stack of notes;
- a discrimination unit for discriminating at least the denomination of notes drawn out by the draw-out unit;
- a sorting unit for sorting notes according to the denomination of the notes discriminated by the discrimination unit;
- a plurality of temporary reserving units for temporarily reserving notes sorted by the sorting unit according to the denomination of of the notes, said receiving units including supporting plates movable between a closed position for supporting the notes and an open position for releasing the notes;
- a determining unit for determining whether the temporary reserving units are filled with notes;
- a plurality of containers for receiving notes from said temporary reserving units according to the denominations of the notes;
- a first common driving means for lowering said supporting plates of said temporary receiving units;
- clutch means for coupling said first driving means to said supporting plates;
- a second common driving means for causing said supporting plates to open when said first driving means downwardly drives said supporting plates; and
- a control unit for controlling said clutch means to couple said first driving means to said supporting plates when said determining unit determines that one of said temporary reserving units is filled with notes, said first driving means lowering said plates and said second driving means opening said plates to transfer the notes to said containers.

2. An apparatus according to claim 1, which further comprises transfer instruction means for providing a transfer instruction to said control unit, said control unit transferring the notes reserved in said temporary reserving units to their respective containers upon receipt of said transfer instruction.

3. A note-sorting and counting apparatus comprising:
- a draw-out unit for drawing out notes in succession from a stack of notes;
- a discrimination unit for discriminating at least the denomination of notes drawn out by the draw-out unit;
- a buffer memory for storing the number of notes drawn out in each denomination;
- a sorting unit for sorting notes according to the denomination of note discriminated by the discrimination unit;
- a plurality of containers for receiving, according to the the denomination of the notes, the notes sorted by the sorting unit;
- a stop control unit for stopping the operation of the draw-out unit when the number of notes discriminated by the discrimination unit has reached a predetermined number;
- a note saving unit for saving notes drawn out by said draw-out unit before the draw-out unit has drawn-out said predetermined number of notes and the stop control unit has stopped the operation of the draw-out unit, the note saving unit being located between the discrimination unit and the sorting unit;
- a saving count memory unit for sorting for each denomination the number of notes saved by the note savign unit on the basis of the denominations discriminated by the discrimination unit; and
- a control unit for adding the number stored in the saving count memory unit to the number stored in the buffer memory unit in response to a start signal from a start key and for transferring the notes saved by the note saving unit into the containers according to the denomination of notes.

4. An apparatus according to claim 3, wherein the stop control unit comprises a set number memory unit for storing a set number set in advance, and a count comparative computing unit for counting notes discriminated in the discrimination unit to compare a count value with said set number.

5. A note sorting and counting apparatus comprising:
- a draw-out unit for drawing out notes in succession from a stack of notes;

a discrimination unit for discriminating between normal notes and abnormal notes drawn out by the draw-out unit and for discriminating the denominations of the normal notes;

a sorting unit for sorting according to whether the discrimination unit has discriminated the notes as normal notes or abnormal notes and for sorting the normal notes according to their denominations, said sorting unit having gate plates for allowing notes to pass therethrough corresponding to the denominations of the normal notes;

an abnormal note container for receiving abnormal notes sorted by the sorting unit;

a plurality of normal note containers for receiving normal notes sorted by said sorting unit according to the denominations of the normal notes;

a forced transfer instructing unit for instructing a forced transfer of at least of a portion of the notes received in said abnormal note container to a preselected one of said normal note containers, said portion comprising notes removed form said abnormal note container, manually sorted by denomination, and manually re-stacked for drawing out by said draw-out unit;

a designation unit for designating the denomination of the re-stacked notes to be forcedly transferred into said preselected normal note container; and a forced transfer control unit for forcedly transferring all the notes drawn out by said draw-out unit from the re-stacked notes to be forcedly transferred into said preselected container corresponding to the denomination of notes designated by said designation unit, said control unit causing said gate plates to allow the notes to pass therethrough.

6. An apparatus according to claim 5, wherein said forced transfer control unit allows said discrimination unit to discriminate notes drawn out, and forcedly transfers the notes discriminated as normal.

7. A note sorting and counting apparatus as set forth in claim 6, wherein said forced transfer unit forcedly transfers notes discriminated as having a certin denomination designated by said denomination designating unit.

* * * * *